US009158225B2

(12) United States Patent
Fukushima

(10) Patent No.: US 9,158,225 B2
(45) Date of Patent: Oct. 13, 2015

(54) ELECTROPHOTOGRAPHIC IMAGE FORMING APPARATUS WITH DETECTION OF REMAINING DEVELOPER AMOUNT

(75) Inventor: Naoki Fukushima, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 343 days.

(21) Appl. No.: 13/554,390

(22) Filed: Jul. 20, 2012

(65) Prior Publication Data

US 2013/0039669 A1 Feb. 14, 2013

(30) Foreign Application Priority Data

Aug. 12, 2011 (JP) ..... 2011-176733

(51) Int. Cl.
*G03G 15/01* (2006.01)
*G03G 15/08* (2006.01)
*G03G 15/06* (2006.01)

(52) U.S. Cl.
CPC ..... *G03G 15/065* (2013.01)

(58) Field of Classification Search
CPC ..... G03G 15/065
USPC ..... 399/27, 28, 29, 30, 53, 55, 270, 285
See application file for complete search history.

(56) References Cited

U.S. PATENT DOCUMENTS

| | | | | |
|---|---|---|---|---|
| 5,999,782 | A * | 12/1999 | Iguchi et al. | 399/270 |
| 6,134,396 | A * | 10/2000 | Kaneko | 399/55 |
| 2005/0175366 | A1* | 8/2005 | Hasegawa et al. | 399/50 |
| 2007/0206966 | A1 | 9/2007 | Komiya et al. | |

FOREIGN PATENT DOCUMENTS

| | | | | |
|---|---|---|---|---|
| JP | 11305499 | A * | 11/1999 | G03G 15/00 |
| JP | 2003-255688 | A | 9/2003 | |
| JP | 2004-157387 | A | 6/2004 | |
| JP | 2005-164920 | A | 6/2005 | |
| JP | 2005-309145 | A | 11/2005 | |
| JP | 2007-025251 | A | 2/2007 | |

OTHER PUBLICATIONS

Machine English Translation of JP 11-305499 published on Nov. 5, 1999.*

Office Action in Chinese Patent Application No. 201210278059.8, dated Mar. 4, 2014.

* cited by examiner

*Primary Examiner* — Billy Lactaoen

(74) *Attorney, Agent, or Firm* — Fitzpatrick, Cella, Harper & Scinto

(57) ABSTRACT

An image forming apparatus includes an image bearing member which bears an electrostatic latent image; a developing device including a developing container which contains a developer, a developer carrying member which carries the developer to develop the electrostatic latent image, and an electrode member provided in the developing container; a voltage applying device which applies an alternate-current voltage to the developer carrying member; and a detecting device which detects information on a capacitance between the developer carrying member and the electrode member when the voltage applying device applies the alternate-current voltage to the developer carrying member in forming an image. The voltage applying device has, as the alternate-current voltage, a first alternate-current voltage having a first peak-to-peak voltage and a first frequency, and a second alternate-current voltage having a second peak-to-peak voltage higher than the first peak-to-peak voltage and a second frequency lower than the first frequency.

10 Claims, 5 Drawing Sheets

ELECTROPHOTOGRAPHIC IMAGE FORMING APPARATUS WITH DETECTION OF REMAINING DEVELOPER AMOUNT

BACKGROUND OF THE INVENTION

1. Field of the Invention

The present invention relates to an image forming apparatus, such as a copier and a printer, which has a function of forming an image on a recording medium such as a sheet.

2. Description of the Related Art

In an electrophotographic image forming apparatus such as a copier and a laser beam printer, for example, an image formation is performed in the following manner. An electrophotographic photosensitive member (photosensitive member) is irradiated with light corresponding to image data to form an electrostatic image (latent image) on the photosensitive drum. A toner as a developer which is a recording material is supplied from a developing device to the electrostatic image to develop the electrostatic image into a toner image. The toner image is then transferred from the photosensitive member onto a recording medium such as a recording sheet by a transfer device. The toner image is fixed to the recording medium by a fixing device to form a recording image finally.

A developer containing portion is connected to the developing device, and the developer contained in the developer containing portion is conveyed into the developing device by a developer conveying and agitating member, and then the developer is consumed by forming the toner image.

(Detection of Remaining Amount of Developer)

In the image forming apparatus described above, when the apparatus has run out of developer, a user replaces a cartridge with a new one or replenishes the toner to enable the image formation. Therefore, such an image forming apparatus may include a unit which detects the consumption of the developer to inform the user of the consumption, i.e., a developer amount detecting device.

As the developer amount detecting device, there is known a capacitance measuring system that includes at least a pair of input side and output side electrodes and detects the developer amount by measuring a capacitance between the electrodes. As one type of the system, a plate antenna system has been known.

In the plate antenna system, for example, if a developing method of applying an alternate-current bias to a developer carrying member of a developing device is employed, a metal plate serving as an electrode is disposed at a position opposite to the developer carrying member.

The developer amount is then detected by using a capacitance between the metal plate and the developer carrying member based on a current flowing through the metal plate serving as an electrode, which is changed depending on the amount of the developer such as an insulating toner (Japanese Patent Application Laid-Open No. 2003-255688).

Specifically, when a space between the metal plate and the developer carrying member or between two metal plates is filled with the developer, the capacitance is increased, and as the amount of developer decreases, a ratio of the air occupying the space between the metal plate and the developer carrying member or between the two metal plates is increased, and thus the capacitance decreases. Therefore, if a relationship between the developer amount and the capacitance between the metal plate and the developer carrying member or between the two metal plates is obtained in advance, a level of the developer amount can be detected by measuring the capacitance.

However, the conventional technology described above possibly has the following problem.

In the image forming apparatus, a peak-to-peak voltage or a frequency of the developing bias may be changed to obtain a stable image. The remaining amount of the toner is calculated based on a capacitance which is obtained from a value of current flowing through a toner remaining amount detecting member at the time of applying a developing alternate-current voltage. Therefore, the change of the peak-to-peak voltage or the frequency which are parameters of the current value changes the value of current so that there is a possibility that an output value of the detection of the level of the toner remaining amount is changed.

Up to now, there are a technique in which only in a process other than an image forming process, a constant developing bias is applied to detect the toner remaining amount and a technique in which the output value is corrected by control. However, in order to detect the toner remaining amount with more accuracy, it has been demanded to achieve an improvement of accuracy.

SUMMARY OF THE INVENTION

The present invention has been made in view of the above-mentioned situation. According to the invention, an amount of developer can be detected stably with more accuracy even when a developing bias is changed in forming an image.

The present invention provides the following image forming apparatus.

According to an exemplary embodiment of the present invention, an image forming apparatus comprises: an image bearing member which bears an electrostatic latent image; a developing device including a developing container which contains a developer, a developer carrying member which carries the developer to develop the electrostatic latent image, and an electrode member provided in the developing container; a voltage applying device which applies an alternate-current voltage to the developer carrying member; and a detecting device which detects information on a capacitance between the developer carrying member and the electrode member when the voltage applying device applies the alternate-current voltage to the developer carrying member in forming an image, wherein the voltage applying device has, as the alternate-current voltage, a first alternate-current voltage having a first peak-to-peak voltage and a first frequency, and a second alternate-current voltage having a second peak-to-peak voltage higher than the first peak-to-peak voltage and a second frequency lower than the first frequency.

According to the invention, an amount of developer can be detected stably with more accuracy even when a developing bias is changed in forming an image.

Further features of the present invention will become apparent from the following description of exemplary embodiments with reference to the attached drawings.

DESCRIPTION OF THE EMBODIMENT

An exemplary embodiment of the present invention will be hereinafter described in detail with reference to the accompanying drawings. However, sizes, materials, and shapes of structural elements described in the embodiment and their relative arrangements are to be changed as appropriate according to a configuration and various conditions of an apparatus to which the present invention is applied, and therefore, the scope of the present invention should not be construed to be limited by the following embodiment.

The present invention relates to an image forming apparatus which forms an image on a recording medium by using an electrophotographic method or an electrostatic recording method, such as a laser beam printer or a copier.

(Embodiment)

An exemplary embodiment of the present invention will be described in detail below with reference to the accompanying drawings.

(Overall Configuration and Operation of Image Forming Apparatus)

Figure 2:
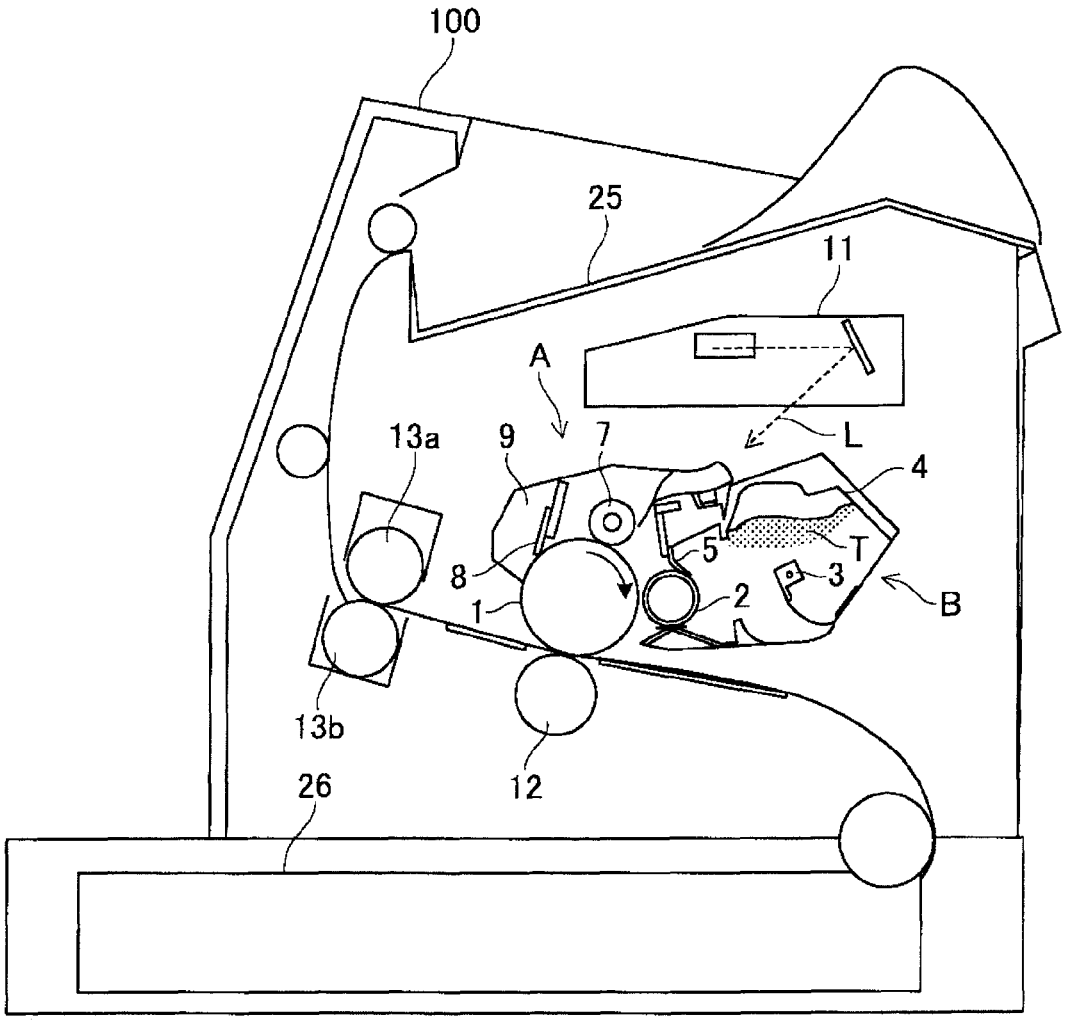
FIG. 2 is a schematic cross-sectional view of an image forming apparatus according to the embodiment.

FIG. 2 is a schematic cross-sectional view of an image forming apparatus 100 according to the embodiment.

The image forming apparatus 100 according to the embodiment is a laser beam printer which receives image information from a host computer or a network and outputs an image corresponding to the image information on a recording medium. The image forming apparatus 100 includes a process cartridge A having a photosensitive member 1 as an image bearing member. The process cartridge A is detachably (replaceably) mounted to a main body of the image forming apparatus 100.

In the image forming apparatus 100 in which the process cartridge A is mounted, a laser scanner 11 which emits a laser light L corresponding to the image information is provided above the process cartridge A, and a transfer unit 12 is provided below the process cartridge A so that the transfer unit 12 is opposite to the photosensitive member 1.

With this configuration, the photosensitive member 1 is uniformly charged by a charging unit 7 in the process cartridge A, and a surface of the photosensitive member 1 is scanned and exposed by the laser light L emitted from the laser scanner 11, to thereby form a desired electrostatic latent image corresponding to the image information on the surface of the photosensitive member 1.

The electrostatic latent image is developed (visualized) into a toner image (developer image) by a toner T as a developer contained in a toner container 4 as a developing container, the toner T adhering to the electrostatic latent image by an operation of a developing roller 2 provided in a developing device B. In the embodiment, an insulating magnetic single-component toner is used as the developer. The developing roller 2 corresponds to a developer carrying member which carries the developer contained in the toner container 4.

The transfer unit 12 transfers the toner image on the photosensitive member 1 to a recording medium fed from a cassette 26. The recording medium is heated and pressurized by a pair of fixing rollers 13*a* and 13*b* as a fixing unit, to thereby fix the unfixed toner image onto the recording medium, and the recording medium is then discharged to a discharge tray 25 of the main body. After the toner image is transferred onto the recording medium, the toner T remaining on the photosensitive member 1 is collected into a waste toner container (cleaning container) 9 by a cleaning unit 8.

Figure 3:
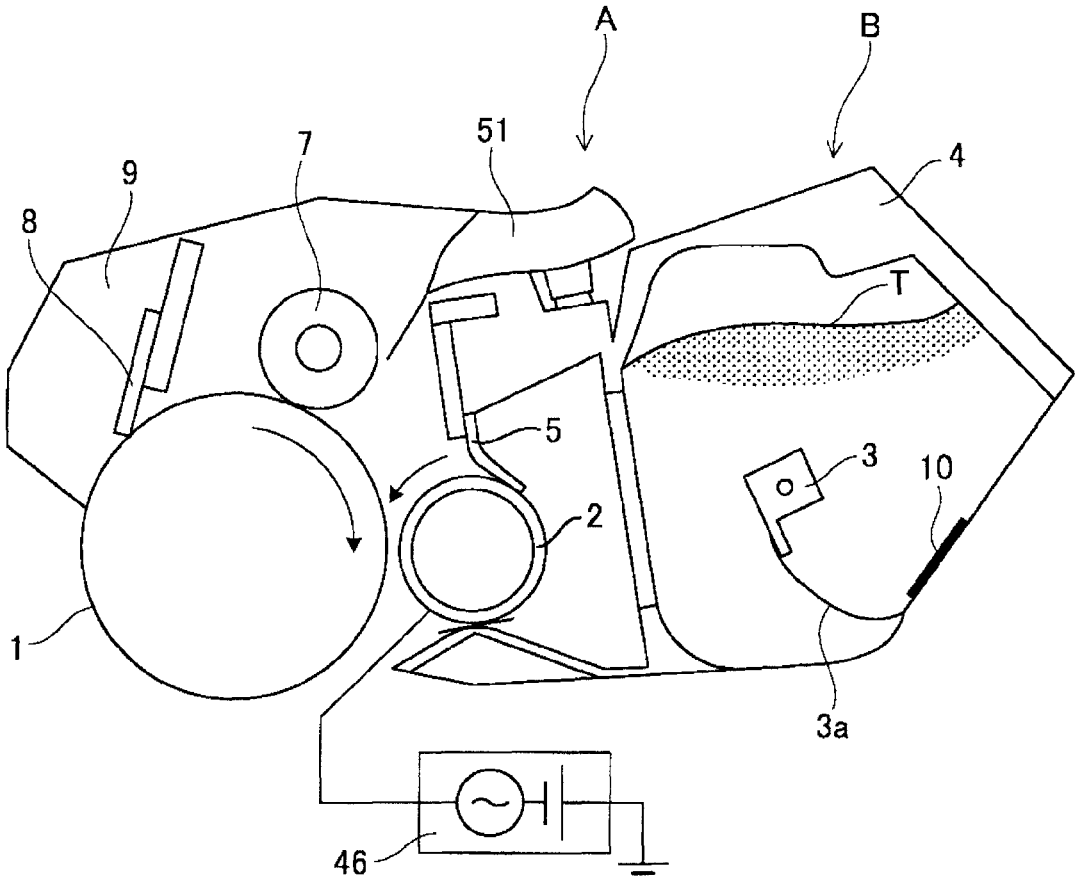
FIG. 3 is a schematic cross-sectional view of a process cartridge containing a toner according to the embodiment.

FIG. 3 is a schematic cross-sectional view of the process cartridge A containing the toner T.

As illustrated in FIG. 3, the process cartridge A is integrally composed of the photosensitive member 1, the charging unit 7, the developing device B, the cleaning unit 8, and the waste toner container 9. The charging unit 7 is configured to uniformly charge the photosensitive member 1. The developing device B is disposed opposite to the photosensitive member 1. The waste toner container 9 is configured to contain the waste toner removed (collected) from the photosensitive member 1 by the cleaning unit 8.

The developing device B includes the developing roller 2 as the developer carrying member, a toner regulating member 5, and the toner container 4 as a containing portion of the toner T. The developing roller 2 and the toner regulating member 5 constitute a developing unit. A bottom surface of the toner container 4 forms a recessed portion (recessed shape). A toner conveying member 3 which is driven by a motor (driving source) provided in the image forming apparatus 100 is disposed opposite to the recessed portion of the bottom surface of the toner container 4. A rotation of the toner conveying member 3 loosens and conveys (supplies) the toner T to the developing roller 2.

The toner conveying member 3 is provided with an agitating vane member 3*a*. A rotation radius of the agitating vane member 3*a* is larger than a radius of the recessed portion of the bottom surface of the toner container 4 so that a tip of the agitating vane member 3*a* is configured to rub on the bottom surface of the toner container 4. With this configuration, a lateral conveyance of the toner T is performed without leaving the toner T on the bottom surface of the toner container 4.

(Developer Amount Detecting System)

In the embodiment, a toner remaining amount detecting system (developer amount detecting system) using a plate antenna 10 as an electrode (developer amount detecting member) is employed. A configuration of the system will be described with reference to FIG. 3.

The plate antenna 10 is formed by a sheet-metal processing of a metal plate that is an electrically conductive member. As illustrated in FIG. 3, the plate antenna 10 is disposed inside the toner container 4 and opposite to the developing roller 2 along the recessed shape of the toner container 4. In the embodiment, the plate antenna 10 is configured such that a surface of the metal plate is substantially parallel to a rotation axis of the developing roller 2 and extends across the whole area in a longitudinal direction (the rotation axial direction of the developing roller 2). In addition, the plate antenna 10 is disposed along the toner container 4 to interpose a part of an operation (movement) area of the toner conveying member 3 between the developing roller 2 and the toner container 4.

Figure 4:
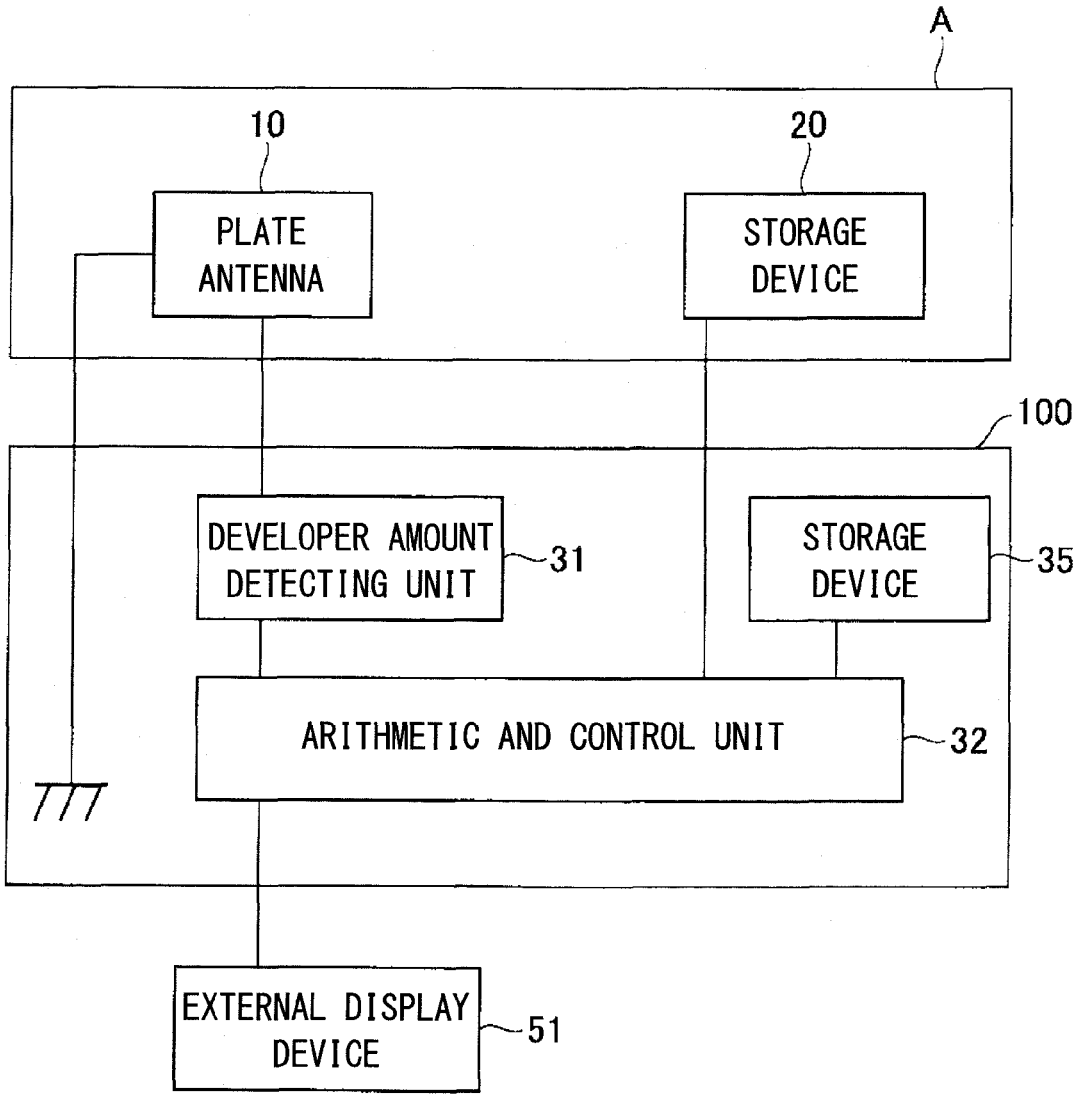
FIG. 4 is a block diagram of a developer amount detecting system according to the embodiment.

FIG. 4 is a block diagram of the developer amount detecting system of the process cartridge A using the plate antenna 10 according to the embodiment.

As illustrated in FIG. 4, the developer amount detecting system includes the plate antenna 10, a storage device 20, a developer amount detecting unit 31, an arithmetic and control unit 32, a storage device 35, and an external display device (display unit) 51.

The plate antenna 10 and the storage device (storage unit) 20 are disposed in the process cartridge A. The developer amount detecting unit 31, the arithmetic and control unit (arithmetic and control portion) 32, and the storage device (storage unit) 35 are disposed in the main body of the image forming apparatus 100 outside the process cartridge A. The external display device 51 is electrically connected to the image forming apparatus 100. The arithmetic and control unit 32 constitutes a developer amount deriving unit and a control unit.

Although the external display device 51 is used in the embodiment, the display unit is not limited thereto. A display unit provided in the main body of the image forming apparatus 100 may be used.

An alternate-current voltage V(t) can be subjected to a Fourier expansion as defined by Equation (1). The current value I(t) flowing through the plate antenna 10 can be obtained by differentiating the alternate-current voltage V(t), and is defined by Equation (2). Equation (2) tells that the current value is proportional to the frequency and the peak-to-peak voltage.

$$V(t) = Vpp \cdot \sum_{n=0}^{\infty} \{A_n \sin(2\pi f \cdot n \cdot t) + B_n \cos(2\pi f \cdot n \cdot t)\} \quad \text{(Equation 1)}$$

$$\begin{aligned} I(t) &= C\frac{dV(t)}{dt} \\ &= C \cdot Vpp \cdot 2\pi f \cdot \sum_{n=1}^{\infty} n\{A_n \sin(2\pi f \cdot n \cdot t) + B_n \cos(2\pi f \cdot n \cdot t)\} \\ &\propto Vpp \cdot f \end{aligned} \quad \text{(Equation 2)}$$

An operation of detecting the developer amount by the developer amount detecting system will be described below.

A predetermined (preset) AC bias (alternate-current voltage) is applied to the developing roller 2 by a bias generating unit (voltage applying device) 46, to thereby induce (generate) in the plate antenna 10 a current corresponding to a capacitance between the plate antenna 10 and the developing roller 2. The current value is converted into a voltage value (information on the capacitance) by the developer amount detecting unit (converting unit) 31.

The voltage value is temporarily stored in the storage device 35 of the main body of the image forming apparatus 100 via the arithmetic and control unit 32. When the number of pieces of data of the voltage values reaches a number of pieces of data for one period (one revolution) of agitation of the toner conveying member 3, an average value of the voltage values is calculated by the arithmetic and control unit 32. The calculated average value is stored in the storage device 20.

A reference value (output value obtained at the initial stage of using the image forming apparatus 100 (in the embodiment, the minimum value of the output value illustrated in FIG. 5, which will be described later)) of the voltage value (output value) is stored in the storage device 20. A toner amount is calculated (derived) by the arithmetic and control unit 32 based on a difference between the reference value and the calculated average value of the voltage values.

A relationship between the toner amount in the toner container (developing container) 4 and the difference between the reference value and the average value of the voltage values is obtained in advance by an experiment and stored (preset) in advance in the storage device 35.

The toner amount detected by using the plate antenna 10 is displayed on the external display device 51 as a toner amount display signal so that a user is informed of the toner amount.

(Developing Bias Control)

In the image forming apparatus, in order to provide a stable image, a peak-to-peak voltage Vpp and a frequency "f" of the developing bias (alternate-current voltage) may be changed depending on a state of the toner and an environmental change. When those development settings (developing bias setting and developing condition) are changed, a current value I(t) flowing through the plate antenna 10 may be changed.

Therefore, the inventor of the present invention has studied a development setting that prevents the current value flowing through the plate antenna 10 from being changed.

Figure 5:
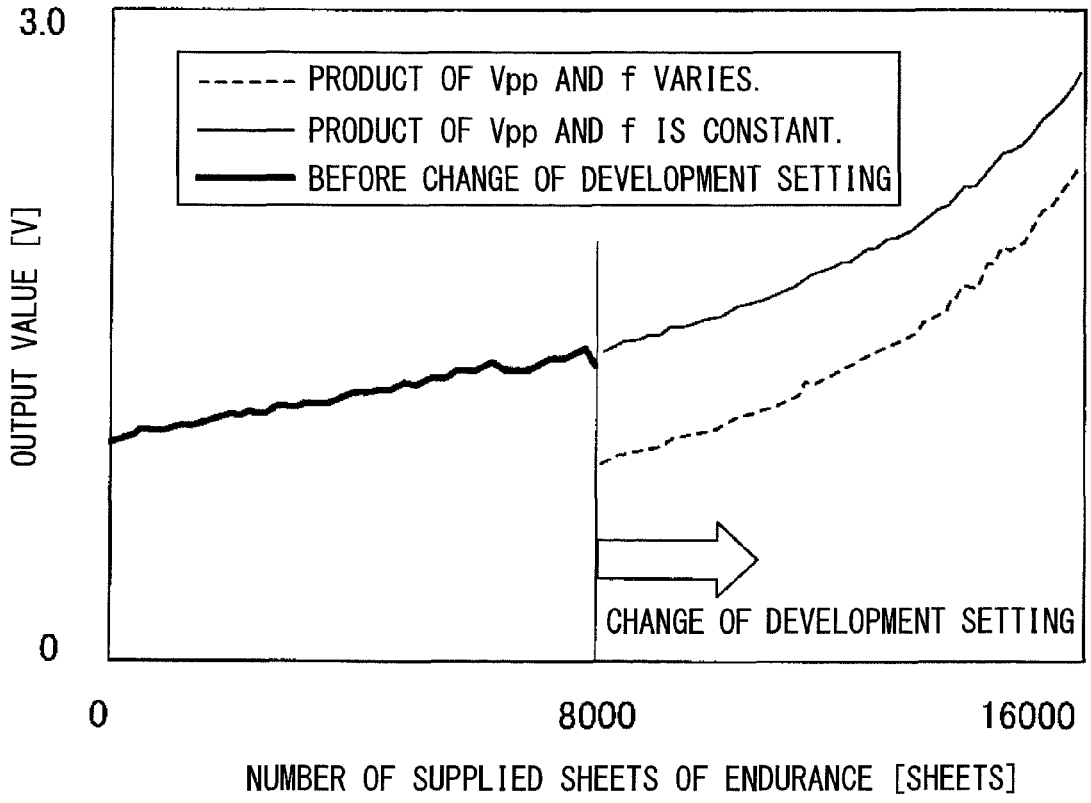
FIG. 5 is a graph showing an output value of an average voltage value calculated by an arithmetic and control unit according to the embodiment.

In FIG. 5, the horizontal axis represents the number of supplied sheets of endurance and the vertical axis represents the output value (voltage value (V)) obtained by calculating the average value by the arithmetic and control unit 32. FIG. 5 shows a difference of output value between a case where only the peak-to-peak voltage is increased and a case where the peak-to-peak voltage is increased while keeping a product of the peak-to-peak voltage and the frequency constant (constant value).

In FIG. 5, a thick line represents a transition before changing the development setting, in which the output value is continuously changed with the number of supplied sheets of endurance, as the toner amount is changed with the number of supplied sheets of endurance and accordingly the capacitance between the developer carrying member and the plate antenna 10 is changed.

A dashed line of FIG. 5 represents a transition when only the peak-to-peak voltage is increased from 1.7 kV to 1.8 kV. In this case, the output value shows a significant change between before and after a changeover of the development setting at around 8,000 sheets.

In addition, a solid line (thin line) of FIG. 5 shows a transition when the peak-to-peak voltage is increased from 1.7 kV to 1.8 kV, and at the same time, the frequency is decreased from 2.7 kHz to 2.55 kHz to keep the product of the peak-to-peak voltage and the frequency constant. In this case, the output value shows virtually no change between before and after the changeover of the development setting.

From the above description, it is found that the product of the peak-to-peak voltage and the frequency should be kept constant in order to prevent the value of current flowing through the plate antenna 10 from being changed due to the development setting.

Examples of an adverse effect on the image, which is changed by the development setting, include a fogged image and a density degradation caused by a deterioration of the toner. In general, development characteristics are changed by an alternate-current (AC) component of the developing bias. When the frequency of the AC component is increased, a less fogged image is obtained because the number of pulling back the toner is increased. In addition, when an amplitude is increased, the developing performance is increased because a potential difference is increased in a bright area, and thus an image of a high density is obtained as a whole.

That is, the fogged image can be improved by increasing the developing frequency or decreasing the peak-to-peak voltage. On the other hand, the density degradation due to the deterioration of the toner is improved by increasing the developing performance, and hence it is required to increase the peak-to-peak voltage or to decrease the developing frequency to improve the density degradation.

Therefore, each adverse effect on the image can be improved in a state in which the product of the peak-to-peak voltage and the frequency is kept constant.

Figure 1:
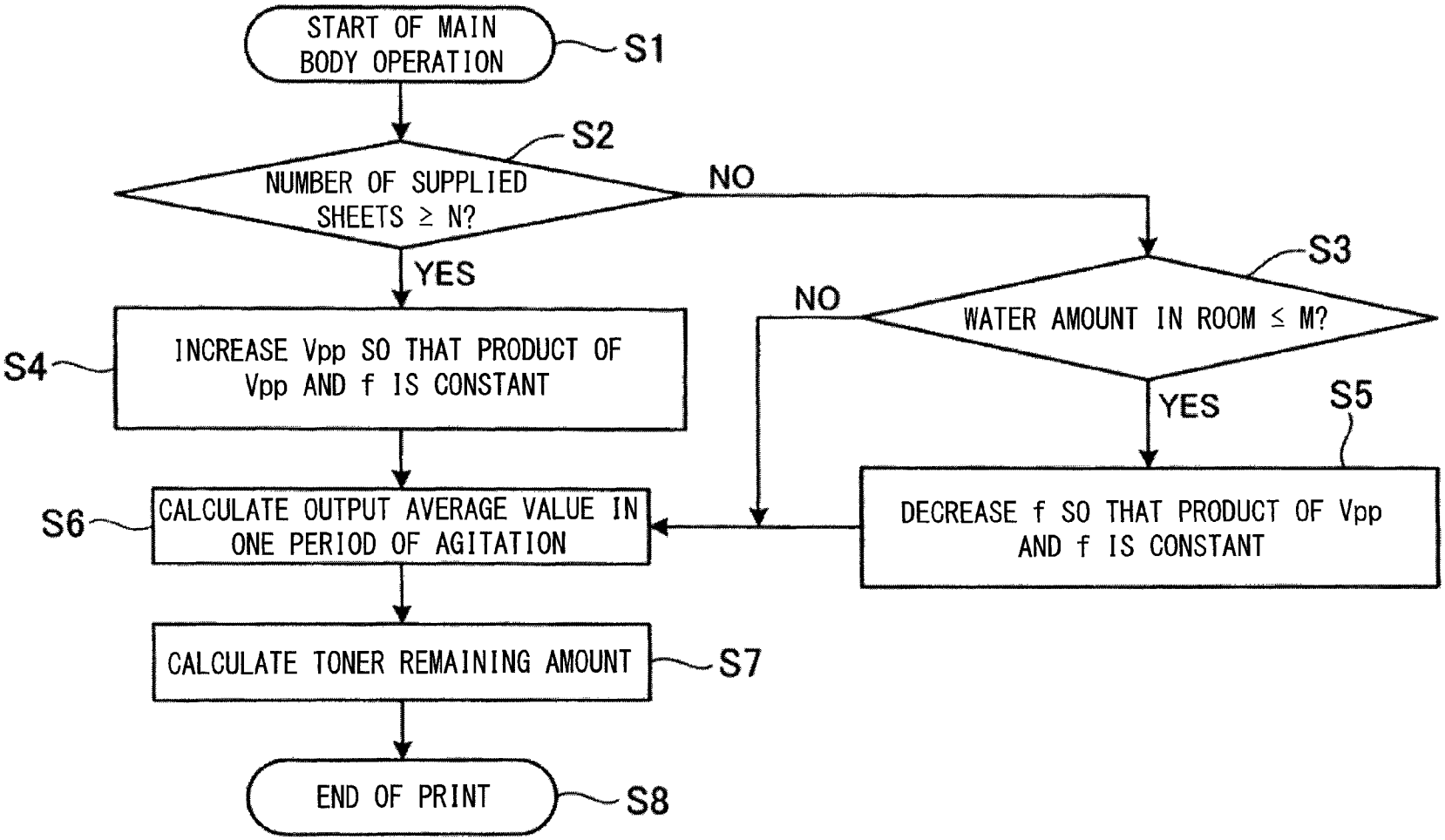
FIG. 1 is a flowchart of a developing alternate-current voltage control according to an embodiment.

A developing alternate-current voltage control performed by the arithmetic and control unit 32 in the embodiment will be described below with reference to a flowchart illustrated in FIG. 1. FIG. 1 is a flowchart of the developing alternate-current voltage control according to the embodiment.

After starting an image forming operation in the main body of the image forming apparatus 100 (Step S1), when the number of supplied sheets (accumulated number of sheets used to form an image from a brand new status) is equal to or larger than N (YES in Step S2), the peak-to-peak voltage is increased and the frequency is decreased to keep the product of the peak-to-peak and the frequency constant as a measure against the density degradation due to the deterioration of the toner (Step S4). In the embodiment, N is 8,000 sheets. In the embodiment, the peak-to-peak voltage is set to be increased from 1.7 kV to 1.8 kV and the frequency is set to be decreased from 2.7 kHz to 2.55 kHz. As described above with reference to FIG. 5, by keeping the product of the peak-to-peak voltage and the frequency constant, the output value of the developer amount detecting unit 31 shows virtually no change.

After that, at the time of applying the developing alternate-current voltage, an output average value of the voltage values converted from the current value of the current flowing through the plate antenna 10 in one period of agitation is calculated (Step S6), and the toner remaining amount is calculated from a difference between the output average value and the reference value (Step S7).

Under a low temperature and low humidity environment, it is concerned that the fogged image becomes worse due to a change of charging performance of the toner. For this reason, even if the number of supplied sheets is smaller than 8,000 sheets (NO in Step S2), when the absolute water amount in room is equal to or less than M g/m$^3$ (YES in Step S3), the frequency is set to be increased and the peak-to-peak voltage is set to be decreased to keep the product of the peak-to-peak voltage and the frequency constant (Step S5). In the embodiment, M is 5 g/m$^3$. In the embodiment, the frequency is set to be increased from 2.7 kHz to 2.9 kHz and the peak-to-peak voltage is set to be decreased from 1.7 kV to 1.58 kV. Therefore, the output value of the developer amount detecting unit 31 shows virtually no change. When the determination is NO in Step S3, or after Step S5, the process proceeds to Step S6.

Although a preset condition for determining the deterioration of the toner is the number of supplied sheets of 8,000 sheets or larger in the embodiment, the condition is not limited to this. In addition, although the criterion for determining the deterioration of the toner is made based on the number of supplied sheets in the embodiment, the criterion is not limited to this, and may be a lifetime of the photosensitive member 1 or the toner remaining amount.

For example, a control of increasing the peak-to-peak voltage from 1.7 kV to 1.8 kV and decreasing the frequency from 2.7 kHz to 2.55 kHz when the accumulated number of revolutions of the photosensitive member 1 (accumulated number of revolutions from a brand new status) reaches a predetermined number or larger can achieve the same effect as that of the embodiment. In addition, a control of increasing the peak-to-peak voltage from 1.7 kV to 1.8 kV and decreasing the frequency from 2.7 kHz to 2.55 kHz when the toner remaining amount is below a predetermined amount can also achieve the same effect as that of the embodiment.

As described above, the image forming apparatus according to the embodiment employs the following two alternate-current voltages in a configuration which detects information on the capacitance between the developing roller 2 and the plate antenna 10 by applying an alternate-current voltage to the developing roller 2 at the time of forming an image in order to prevent a current flowing through the plate antenna 10 from being changed due to a change of the developing bias to achieve a stable image. Specifically, the image forming apparatus employs a first alternate-current voltage having a peak-to-peak voltage of 1.7 kV (first peak-to-peak voltage) and a frequency of 2.7 kHz (first frequency) and a second alternate-current voltage having a peak-to-peak voltage of 1.8 kV (second peak-to-peak voltage) and a frequency of 2.55 kHz (second frequency).

As one configuration for achieving the same effect as that of the embodiment, the first alternate-current voltage may be applied to the developing roller when the toner is in a first state and the second alternate-current voltage may be applied to the developing roller when the toner is in a second state in which the toner is more deteriorated than in the first state. As another configuration, the first alternate-current voltage may be applied to the developing roller when the accumulated number of revolutions of a photosensitive drum is a first number and the second alternate-current voltage may be applied to the developing roller when the accumulated number of revolutions of the photosensitive drum is a second number larger than the first number. As still another configuration, the first alternate-current voltage may be applied to the developing roller when the toner remaining amount is a first amount and the second alternate-current voltage may be applied to the developing roller when the toner remaining amount is a second amount smaller than the first amount. By employing such configurations, even when the setting of the developing bias is changed to obtain a stable image, the toner amount can be detected in a more stable manner at the time of forming an image. This enables an improvement of the accuracy of the detection of the toner remaining amount. In particular, it is desired to keep the product of the peak-to-peak voltage and the frequency of the developing bias constant to prevent the current value of the current flowing through the plate antenna 10 from being affected even when the peak-to-peak voltage or the frequency is changed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2011-176733, filed Aug. 12, 2011, which is hereby incorporated by reference herein in its entirety.

What is claimed is:

1. An image forming apparatus, comprising:

an image bearing member which bears an electrostatic latent image;

a developing device including:

a developing container which contains a developer;

a developer carrying member which carries the developer to develop the electrostatic latent image; and an electrode member provided in the developing container;

a voltage applying device which applies an alternate-current voltage to the developer carrying member; and a detecting device which detects information on a capacitance between the developer carrying member and the electrode member when the voltage applying device applies the alternate-current voltage to the developer carrying member during developing the electrostatic latent image, wherein the voltage applying device has, as the alternate-current voltage, a first alternate-current voltage having a first peak-to-peak voltage and a first frequency, and a second alternate-current voltage having a second peak-to-peak voltage higher than the first peak-to-peak voltage and a second frequency lower than the first frequency, and wherein the voltage applying device changes the first peak-to-peak voltage into the second peak-to-peak voltage if a number of sheets used to form an image is equal to or greater than a predetermined number.

2. An image forming apparatus according to claim 1, wherein a product of the first peak-to-peak voltage and the first frequency of the first alternate-current voltage is equal to a product of the second peak-to-peak voltage and the second frequency of the second alternate-current voltage.

3. An image forming apparatus according to claim 1, wherein the voltage applying device applies the second alternate-current voltage in a first temperature environment and applies the first alternate-current voltage in a second temperature environment in which a temperature is lower than that in the first temperature environment.

4. An image forming apparatus according to claim 1, wherein the voltage applying device applies the second alternate-current voltage in a first humidity environment and applies the first alternate-current voltage in a second humidity environment in which a humidity is lower than that in the first humidity environment.

5. An image forming apparatus according to claim 1, wherein the voltage applying device applies the first alternate-current voltage when an accumulated number of revolutions of the image bearing member is a first number and applies the second alternate-current voltage when the accumulated number of revolutions of the image bearing member is a second number larger than the first number.

6. An image forming apparatus according to claim 1, wherein the voltage applying device applies the first alternate-current voltage when the developer is in a first state and applies the second alternate-current voltage when the developer is in a second state in which the developer is more deteriorated than in the first state.

7. An image forming apparatus according to claim 1, wherein the voltage applying device applies the first alternate-current voltage when a remaining amount of the developer in the developing container is a first amount and applies the second alternate-current voltage when the remaining amount of the developer in the developing container is a second amount smaller than the first amount.

8. An image forming apparatus according to claim 1, wherein a product of the first peak-to-peak voltage and the first frequency is kept constant.

9. An image forming apparatus according to claim 1, wherein a product of the second peak-to-peak voltage and the second frequency is kept constant.

10. An image forming apparatus, comprising:

an image bearing member which bears an electrostatic image;

a developing device including:

a developing container which contains a developer;

a developer carrying member which carries the developer to develop the electrostatic image; and an electrode member provided in the developing container;

a voltage applying device which applies an alternate-current voltage to the electrode member; and a detecting device which detects information on a capacitance on the electrode member when the voltage applying device applies the alternate-current voltage to the electrode member during developing the electrostatic image, wherein the voltage applying device has, as the alternate-current voltage, a first alternate-current voltage having a first peak-to-peak voltage and a first frequency, and a second alternate-current voltage having a second peak-to-peak voltage higher than the first peak-to-peak voltage and a second frequency lower than the first frequency, and wherein the voltage applying device changes the first peak-to-peak voltage into the second peak-to-peak voltage if a number of sheets used to form an image is equal to or greater than a predetermined number.

* * * * *